United States Patent [19]

Torti

[11] Patent Number: 4,955,421

[45] Date of Patent: Sep. 11, 1990

[54] CONTINUOUS CORD ROLL UP BLIND

[75] Inventor: Anthony Torti, Warwick, R.I.

[73] Assignee: Kenney Manufacturing Company, Warwick, R.I.

[21] Appl. No.: 401,083

[22] Filed: Aug. 31, 1989

[51] Int. Cl.[5] ..... A47H 1/00

[52] U.S. Cl. ..... 160/243; 160/170

[58] Field of Search ..... 160/243, 244, 245, 84.1, 160/171, 170

[56] References Cited

U.S. PATENT DOCUMENTS 4,603,725 8/1986 Knight ..... 160/243

*Primary Examiner*—David M. Purol

*Attorney, Agent, or Firm*—Eric M. Lee

[57] ABSTRACT

This invention relates to a continuous cord roll up window blind. This continuous cord roll up window blind has an endless cord that engages and causes a sprocket to rotate. The sprocket in turn causes a take up spool to rotate. When the take up spool rotates, a take up cord, which is wrapped around the window covering material, either wraps around or unwraps from the take up spool, depending upon which way the take up spool is rotated. This in turn causes the take up cord to raise or lower the window covering material. A take up cord guide is positioned by the take up cord and, when the window blind is completely rolled down, limits the direction in which the endless cord can be pulled to require that the window blind be rolled up toward the interior surface of the window blind.

8 Claims, 4 Drawing Sheets

CONTINUOUS CORD ROLL UP BLIND

BACKGROUND OF THE INVENTION

This invention relates to window blinds. More particularly this invention relates to window blinds that can be rolled up and rolled down with a continuous or endless cord.

In the typical window blind, a plurality of sets of cords are used to roll the blinds up or down. Generally, one set of cords is used at each of several places vertically along the window blind. These sets of cords are connected to the material used to cover the window. The cords extend up into the headrail where they are guided to one end of the headrail. At the end of the headrail, the cords exit the headrail and hang along one edge of the window blind. Typically, at least two sets of these cords are used along the length of the window blind. For window blinds that cover wider windows, additional sets of cords may be used.

When the window blind is raised, the cords hanging at the end of the window blind are pulled downwardly, thereby causing the window covering material to be raised by the cords. The window blind is set in position by a locking mechanism which locks the cords hanging at the end of the window blind and thus the window covering material in the desired position. When the window blind is to be lowered, the cords are pulled to unlock the cords from the locking mechanism. The weight of the window covering material pulls down the cords thereby lowering the window covering material and simultaneously raising the cords at the end of the window blind. The cords and the window covering material can then be locked in place at the desired height, or the window covering material can be lowered to its full length.

Some blinds of this type have the lower end of the window covering material arranged so that when the cords are pulled to raise the material, it rolls up on itself. For example, the bottom of the window covering material might be affixed to spools along the length of the material. Although any type of material could be used, it is common for such blinds to be made of bamboo. Blinds of this type are referred to as roll up blinds.

One problem with such a typical window blind is that when the blind is raised, the cords hanging at one end of the window blind which are used to raise and lower the window blind reach a long length. In cases where the blinds are designed to cover a window of substantial height, these cords can be of substantial length and may accumulate on the floor. This is undesirable for safety as well as aesthetic reasons. People may trip over these long lengths of cords. Moreover, small children can become entangled in them, possibly becoming strangled.

Another problem with the typical window blind having more than one set of cords to raise and lower the window covering material is that it is difficult to maintain the window covering material horizontal when the blind is raised and lowered. If one or more sets of cords are not pulled downward or allowed to rise the same distance as the other sets of cords, one set of cords associated with one end of the window blind may be raised or lowered a greater distance than another set of cords associated with another end of the window blind. As a result, one end of the window blind may be raised or lowered a greater distance than the other end of the window blind.

Yet another problem with the typical roll up window blind arises when the window covering material is rolled up, after having been completely unrolled. In that situation, there is no way to control the direction in which the blind will roll up around itself.

If the window covering material rolls up toward the window, several undesirable effects follow. The physical configuration of the rolled up blind is aesthetically undesirable. The rolled up portion of the window covering material may make contact with the window and be forced inward. Also, contact against the window will increase the force required to raise the window covering material and the window covering material or one of the cords may catch on a window lock or other portion of the window, with potentially disastrous results. Further, where the window covering material is rolled up toward the window, the surface of the window covering material facing the room ("the interior surface") would be exposed to the sun while in a rolled up position, with resulting fading. Over time, this interior surface would develop horizontal lines of lighter and darker material, assuming that the blind were left in various partially rolled-up configurations.

Another type of roll up blind utilizes a continuous or endless cord to rotate a rod, around which the window covering material is connected. As the rod is rotated by means of a roll up cord, the window covering material either wraps around or unwraps from the rod, depending upon which way the rod is rotated. One problem with this type of a roll up blind is that, if the roll up cord is continually pulled, the rod will continue to rotate even when the window covering material is either completely rolled up or down. This causes the window covering material to roll up in the wrong direction after it has been completely rolled down, creating an unsightly appearance. On the other hand, if the window covering material has been completely rolled up, the window covering material will just continue to roll up on itself.

It would be desirable to provide a window blind that does not yield a long length of cord when the blind is rolled up.

It would also be desirable to provide a window blind with window covering material that remains substantially horizontal when the window blind is raised and lowered.

It would further be desirable to provide a roll up window blind with window covering material that always rolls up in the same direction on the internal surface of the material.

SUMMARY OF THE INVENTION

It is an object of this invention to provide a window blind that does not yield a long length of cord when the blind is rolled up.

It is another obJect of this invention to provide a window blind with window covering material that remains substantially horizontal when the window blind is raised and lowered.

It is still another object of this invention to provide a roll up window blind with window covering material that always rolls up on the internal surface of the material.

In accordance with this invention, there is provided a window blind that uses an endless cord manipulated by the user to roll the blind up or down, a take up spool, a separate take up cord which engages with the blind to roll the blind up or down, and a take up cord guide for limiting the direction in which the endless cord and spool can rotate. The endless cord engages a sprocket positioned inside the headrail. This sprocket is connected to a take up spool by a shaft. One end of the take up cord that is used to raise and lower the window covering material of the blind is connected to the spool. This take up cord then extends down and around the window covering material with the other end being connected to the headrail. Thus, when one side of the endless cord is pulled, the sprocket rotates, thereby rotating the shaft, which causes the take up spool to rotate. As the spool rotates, the take up cord used to raise and lower the window covering material either wraps around the spool to raise the window blind, or unwraps from the spool to lower the window blind, depending upon which way the sprocket is rotated by the endless cord. A take up cord guide moves along the length of the spool to ensure that the take up cord used to raise and lower the window covering material is wrapped in a smooth single ply around the take up spool. This prevents jams or other damage to the roll up mechanism. The take up cord guide also prevents the user from rotating the take up spool such that the blind will be rolled up toward the window.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
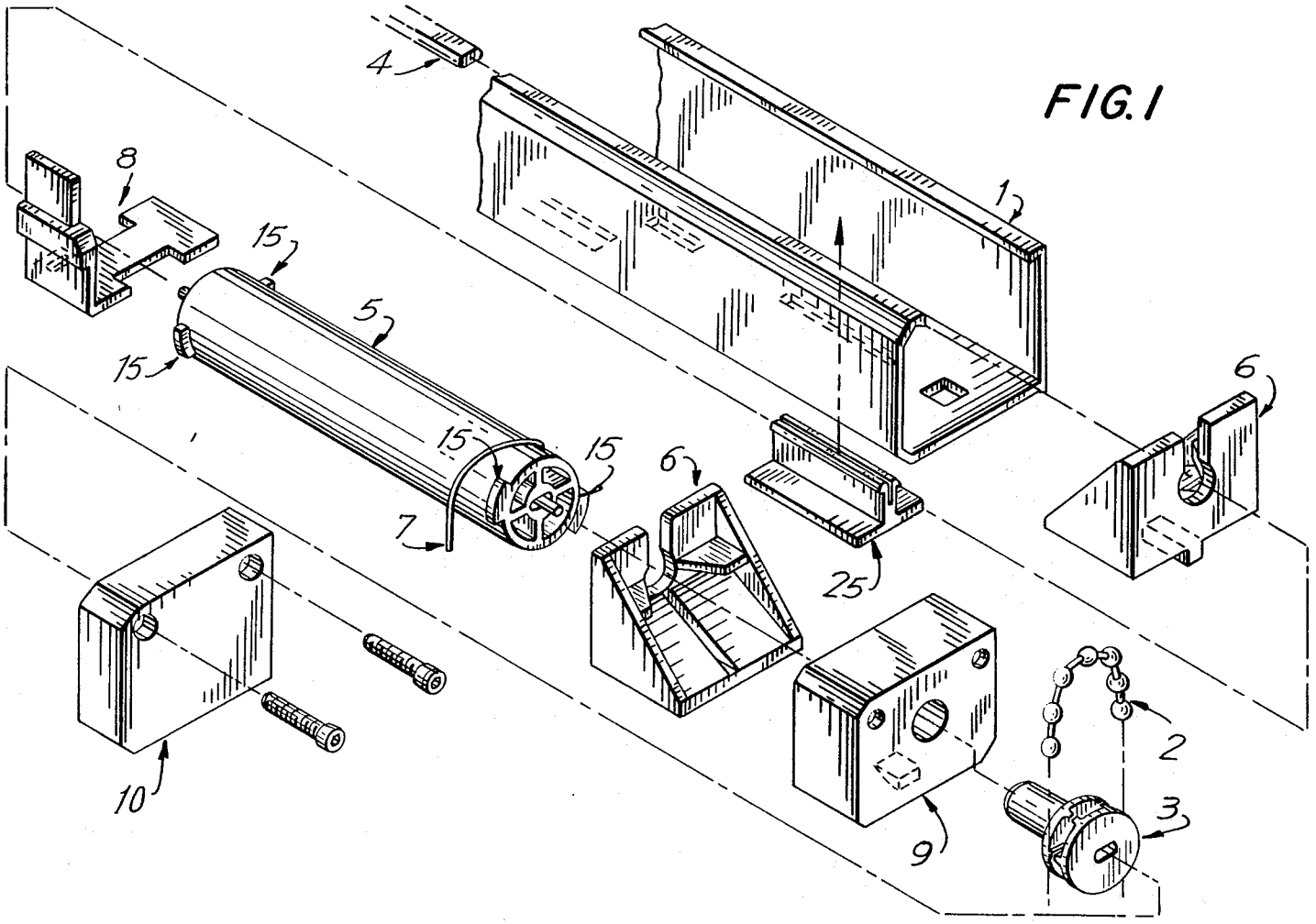
FIG. 1 is an exploded perspective view showing the components of the invention.
Figures 2, 3:
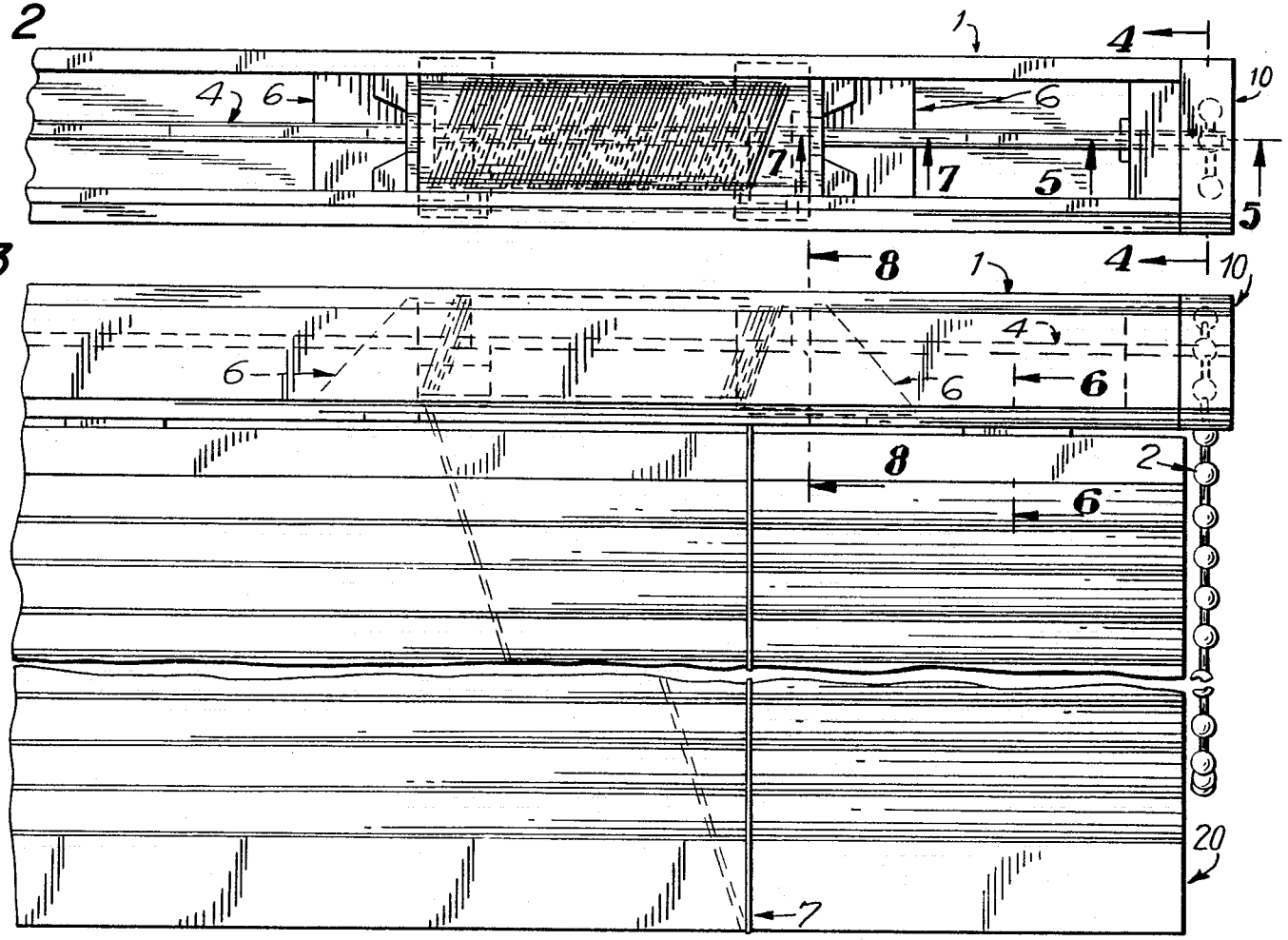
FIG. 2 is a plan view from the top of the invention.
FIG. 3 is an elevation view from the front of FIG. 2 as seen from inside the room where the window is located with the front of the headrail cut away to show the components of the invention.
Figure 5:
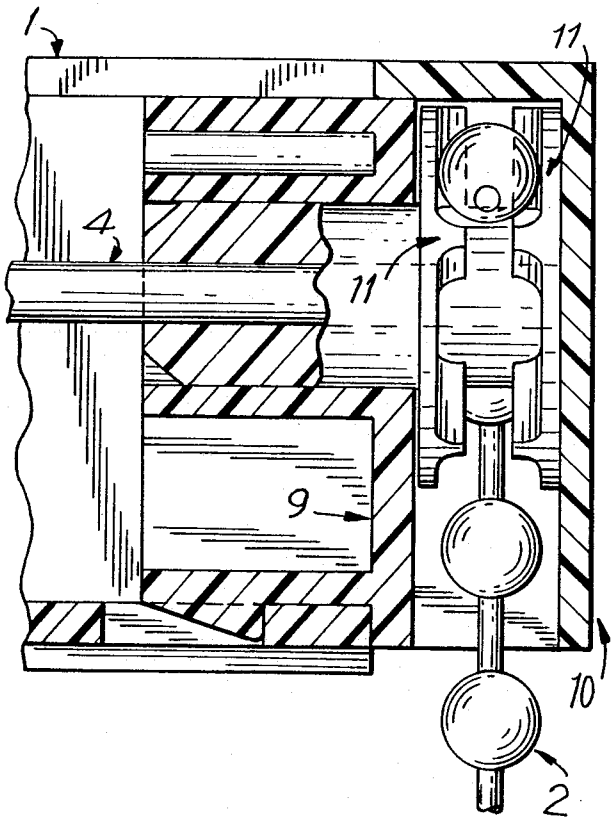
FIG. 5 is an elevation view taken along line 5—5 of FIG. 2.
Figure 4:
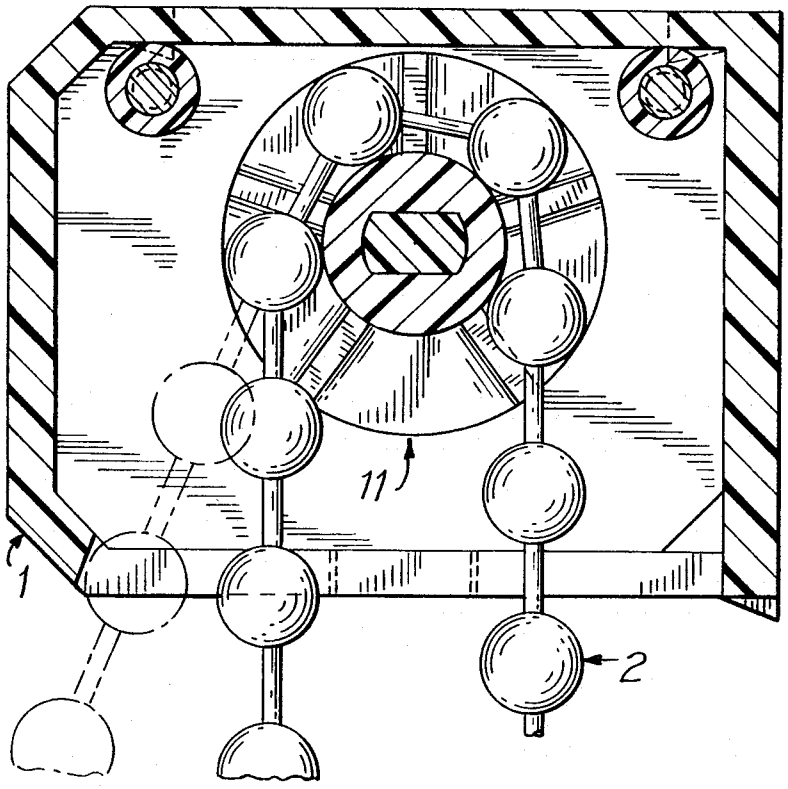
FIG. 4 is an elevation view taken along line 4—4 of FIG. 2.
Figure 6:
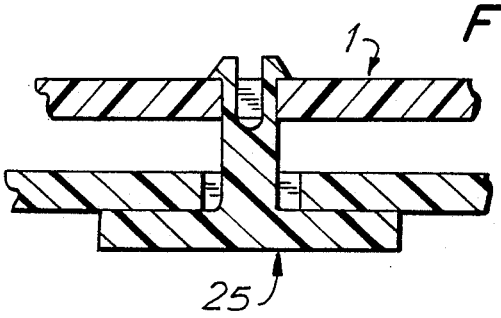
FIG. 6 is an elevation view taken along line 6—6 of FIG. 3.
Figure 7:
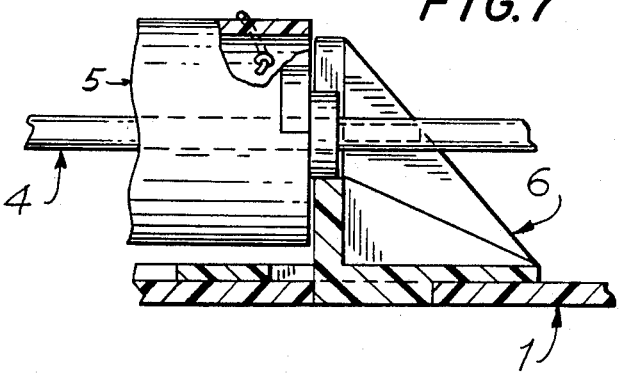
FIG. 7 is an elevation view taken along line 7—7 of FIG. 2.
Figure 8:
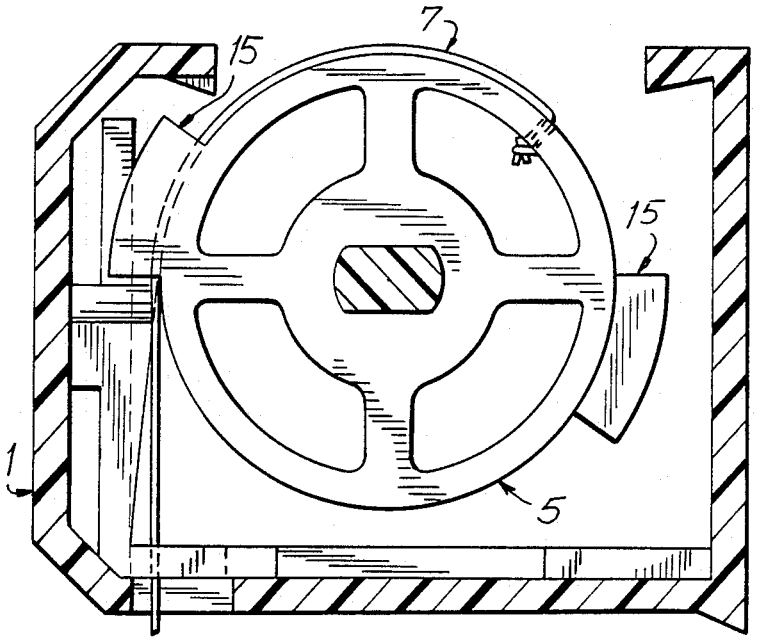
FIG. 8 is an elevation view taken along line 8—8 of FIG. 3.

The continuous cord roll up blind of this invention generally comprises a headrail 1, a roll up cord 2, a sprocket 3, a shaft 4, at least one take up spool 5, a pair of mounting brackets 6 for each take up spool 5, a take up cord 7 for each take up spool 5 and a take up cord guide 8 for each take up spool 5. Although this invention will be described in terms of one take up spool, it is to be understood that any number of take up spools may be used depending on the width of the window blind.

Sprocket 3 is rotatably positioned adjacent to one end of a generally U-shaped headrail 1 having a front wall, a bottom wall and a rear wall. Preferably this is accomplished by fixedly connecting sprocket 3 to one end of shaft 5 which extends about the length of headrail 1 and positioning sprocket 3 adjacent to housing 9. A cover 10 may be used to cover this assembly. One end of sprocket 3 has a pair of flanges 11 defining a space therebetween for insertion of roll up cord 2. Sprocket 3 is preferably formed from ABS (acrylonitrile butadiene styrene).

Roll up cord 2 is preferably an endless beaded chain. Roll up cord 2 extends between flanges 11 with the beads fitting into widened spaces located at regular intervals between flanges 11. This ensures that roll up cord 2 tightly engages sprocket 3 and causes sprocket 3 to rotate when one side of roll up cord 2 is pulled. Roll up cord 2 preferably extends downwardly through an opening in the bottom of cover 10. The beads of roll up cord 2 may be steel or plastic, such as polyester, or any other material that is suitably durable for engaging sprocket 3. The exact design of the interconnection between roll up cord 2 and sprocket 3 is not critical. It is only important that roll up cord 2 engages with sprocket 3 to cause sprocket 3 to rotate when one side of roll up cord 2 is pulled.

Sprocket 3 is connected to take up spool 5, by means of a shaft 4 therebetween. Shaft 4 is preferably formed from steel, although other materials of sufficient strength are suitable. Take up spool 5 is preferably formed from ABS. Take up spool 5 is fixedly connected to shaft 4 and preferably shaft extends completely through the center of take up spool 5 to the other end of headrail 1.

The length and diameter of take up spool 5 should allow take up cord 7 to completely wrap around take up spool 5 in a single layer without any of take up cord 7 left over when the blind is completely rolled up. For window blinds that cover a window about 72 inches high and about 30 inches wide, preferably two take up spools each about 3.45 inches long and about 0.77 inches in diameter are used.

Take up spool 5 is held in position in headrail 1 by bearing brackets 6 located at both ends of take up spool 5. Bearing brackets 6 are preferably formed from ABS. Either shaft 4 or a circular nose located on each end of take up spool 5 rests in an arcuate groove in the top of bearing brackets 6. This groove allows take up spool 5 to rotate freely in bracket 6. Bearing brackets 6 should fit snugly in headrail 1 to ensure that take up spool 5 does not move along the length of headrail 1 during the operation of the window blind. In addition, bearing brackets 6 should ensure that take up spool 5 is properly aligned in headrail 1. This can be accomplished through the use of proJections in the bottom of each bearing bracket 6 which, when aligned with holes in headrail 1 and forced into place, fixedly position brackets 6 and take up spool 5.

Take up cord 7 is preferably attached to one end of take up spool 5. Take up cord 7 then preferably extends through a longitudinal slot in headrail 1 located along the portion of headrail 1 where the front wall meets the bottom wall. From the bottom of headrail 1, the take up cord 7 preferably extends initially down in front of the window covering material 20, around window covering material 20 and then back up to the rear of headrail 1. There take up cord 7 is attached at least as far along headrail 1 as the other end of take up spool 5, measured parallel to the longitudinal axis of take up spool 5. This offset between take up cord 7 behind window covering material 20 and take up cord 7 in front of window covering material 20 ensures that take up cord 7 rolls up around take up spool 5 in a single ply during the rolling up of the window blind and that the window blind will roll up or down in a smooth operation.

Preferably an L-shaped take up cord guide 8 is located between take up spool 5 and headrail 1. One leg of take up cord guide 8 is positioned horizontally below take up spool 5 with the other leg extending vertically upwardly either in front of or behind take up spool 5. A hole for take up cord 7 is preferably located in the bottom horizontal leg of take up cord guide 8.

The combination of tabs 15 on one end of take up spool 5 and take up cord guide 8 serves to ensure that the window blind is always rolled up toward the interior surface of window covering material 20. Preferably a pair of tabs 15 are located at least at one end of take up spool 5 about 180 degrees from one another. For ease of manufacture and to avoid the need for right or left take up spools 5, a pair of tabs 15 may be located at each end of the take up spool 5.

When the blind is in its lowermost position, take up cord 7 is substantially unwound from take up spool 5. Preferably, in this situation, take up cord 7 and take up cord guide 8 are adjacent to the right end of take up spool 5 as seen from the inside of the room where the window is located. The vertical leg of take up cord guide 8 is preferably in front of take up spool 5. In this position, one of tabs 15 engages the top of the vertical leg of take up cord guide 8 preventing the counterclockwise rotation of take up spool 5 (as seen from the end of headrail 1 at which sprocket 3 is rotated). This prevents the window blind from rolling up toward the window. Thus, when the user desires to raise the window blind, roll up cord 2 can only be pulled in the direction to cause sprocket 3 to rotate clockwise as seen from the right end of headrail 1, i.e., to roll up the blind toward the interior surface of window covering material 20.

As sprocket 3 rotates clockwise, take up spool 5 also rotates clockwise because of interconnecting shaft 4. This causes take up cord 7 to wrap around take up spool 5. As take up cord 7 wraps around take up spool 5, take up cord 7 causes take up cord guide 8 to move to the left along the longitudinal axis of take up spool 5. This results in take up cord 7 evenly wrapping around take up spool 5 in a single ply.

To lower the window blind, roll up cord 2 is pulled downward to cause sprocket 3 to rotate counterclockwise. This causes sprocket 3 to rotate counterclockwise. This in turn causes take up spool 5 to rotate counterclockwise because of interconnecting shaft 5. As take up spool 5 rotates counterclockwise, take up cord 7 unwraps from take up spool 5. This causes take up cord guide 8 to move along the length of take up spool 5 to the right.

When the window blind is raised or lowered to a desired height it is locked in position. This is accomplished by inserting roll up cord 2 into a slot (not shown) at the bottom of cover 10. The slot size allows the entry of roll up cord 2 at a position between the beads but does not allow the beads to pass through the slot. Thus, when roll up cord 2 is inserted in the slot, roll up cord 2 cannot rotate. This prevents sprocket 3 from rotating and the height of the window blind from changing.

When two or more take up spools are used, each of the take up spools, take up cords and take up cord guides should be oriented and dimensioned substantially identically with one another. This ensures that when the take up spools are rotated by the sprocket, the take up cords will be wrapped around or unwound from each take up spool at the same rate. This results in the take up cords raising or lowering the window covering material substantially the same distance, thus keeping the window covering material horizontal during raising or lowering.

Window covering material 20 comprising the window blind may be connected to headrail 1 by two or more longitudinal T-shaped members 25. T-shaped member 25 fits into spaces in the bottom of headrail 1 and is held in place by means of lugs extending around the end of T-shaped member 25.

Thus it is seen that a window blind is provided that does not yield a long length of cord when the window blind is rolled up, that maintain the window covering material of the window blind substantially horizontal during raising or lowering, and that only permits the window blind to be rolled up toward the interior surface of the blind. One skilled in the art will appreciate that the present invention can be practiced by other than the described embodiments, which are presented for purposes of illustration and not of limitation and the present invention is limited only by the claims which follow.

What is claimed is:

1. A continuous cord roll up apparatus comprising:

a headrail;

a sprocket rotatably connected at one end of said headrail;

an endless cord in engagement with said sprocket for rotating said sprocket;

a take up spool rotatably connected to said sprocket and comprising a tab portion associated therewith;

a take up cord connected at one end to said take up spool and extending below said headrail and back up to and connected to said headrail; and a generally L-shaped take up cord guide having a generally horizontal leg and a generally vertical leg slidably located between said take up spool and said headrail for interacting with said tab portion of said take up spool to prevent further rotation of said take up spool in one direction when said generally L-shaped take up cord guide is adjacent one end of said take up spool.

2. The continuous cord roll up apparatus of claim 1 wherein said generally L-shaped take up cord guide defines a hole therethrough.

3. The continuous cord roll up apparatus of claim 2 wherein:

said headrail has a generally longitudinal slot located therethrough; and said take up cord extends through said hole of said take up cord guide and through said longitudinal slot in said headrail.

4. The continuous cord roll up apparatus of claim 3 further comprising a bearing bracket positioned at least at one end of said take up spool.

5. A continuous cord roll up apparatus comprising:

a sprocket;

an endless cord in engagement with said sprocket for rotating said sprocket;

a take up spool rotatably connected to said sprocket and comprising a tab portion associated therewith;

a take up cord connected at one end to said take up spool; and a generally L-shaped take up cord guide having a generally horizontal leg and a generally vertical leg slidably located below said take up spool for interacting with said tab portion of said take up spool to prevent further rotation of said take up spool in one direction when said generally L-shaped take up cord guide is adjacent one end of said take up spool.

6. The continuous cord roll up apparatus of claim 5 wherein said generally L-shaped take up cord guide defines a hole therethrough.

7. The continuous cord roll up apparatus of claim 6 wherein said take up cord extends through said hole of said take up cord guide.

8. The continuous cord roll up apparatus of claim 7 further comprising a bearing bracket positioned at least at one end of said take up spool.

* * * * *

UNITED STATES PATENT AND TRADEMARK OFFICE

CERTIFICATE OF CORRECTION

PATENT NO. : 4,955,421

DATED : September 11, 1990

INVENTOR(S) : Anthony Torti, Warwick, R.I.

It is certified that error appears in the above-identified patent and that said Letters Patent is hereby corrected as shown below:

ON THE TITLE PAGE

Please add under "References Cited":

| | | | |
|---|---|---|---|
| 1,848,742 | 3/1932 | Oulsman et al. | |
| 1,891,913 | 12/1932 | Burns | |
| 2,152,116 | 3/1939 | Wade et al. | ..... 156/17 |
| 2,562,259 | 7/1951 | Burns | ..... 160/170 |
| 4,623,012 | 11/1986 | Rude et al. | ..... 160/243 |

Signed and Sealed this

Fourteenth Day of January, 1992

*Attest:*

HARRY F. MANBECK, JR.

*Attesting Officer*

*Commissioner of Patents and Trademarks*